US005732762A

United States Patent [19]

Usui et al.

[11] Patent Number: 5,732,762

[45] Date of Patent: Mar. 31, 1998

[54] APPARATUS FOR HEAT TREATING CASTINGS CONTAINING CORES

[75] Inventors: Hiroshi Usui, Tokyo; Tamio Okamura, Suzuka, both of Japan

[73] Assignees: Honda Giken Kogyo Kabushiki Kaisha; Taiho Industries Co., Ltd., both of Tokyo, Japan

[21] Appl. No.: 612,803

[22] Filed: Mar. 11, 1996

[51] Int. Cl.[6] ..... B22D 29/00

[52] U.S. Cl. ..... 164/270.1; 164/404; 266/252

[58] Field of Search ..... 164/270.1, 269, 164/404, 131, 132; 266/252

[56] References Cited

U.S. PATENT DOCUMENTS

| | | | |
|---|---|---|---|
| 5,423,370 | 6/1995 | Bonnemason et al. | 164/132 |
| 5,531,423 | 7/1996 | Crafton et al. | 266/252 X |

FOREIGN PATENT DOCUMENTS

| | | | |
|---|---|---|---|
| 58-25417 | 2/1983 | Japan | 164/131 |
| 58-25860 | 2/1983 | Japan | 164/131 |
| 59-219410 | 12/1984 | Japan | 164/404 |
| 61-50123 | 11/1986 | Japan . | |
| 2230720 | 10/1990 | United Kingdom | 164/132 |

*Primary Examiner*—J. Reed Batten, Jr.

*Attorney, Agent, or Firm*—Oblon, Spivak, McClelland, Maier & Neustadt, P.C.

[57] ABSTRACT

The apparatus comprises a rack containing a casting that includes a core, a heating chamber that includes a vibration structure for vibrating the rack and in a lower portion thereof a first sand discharge structure for discharging sand falling from the casting for removing casting sand and core sand adhering to the casting while heat treating the casting, and a cooling chamber that includes a water tank for immersing the rack containing the casting, an elevator structure for lowering the rack into the water tank and lifting the rack out of the water tank, an oscillation structure for oscillating the rack when the rack is in the water tank, and a second sand discharge structure for discharging sand falling onto a bottom of the water tank for washing off casting sand and core sand adhering to the casting ejected from the heating chamber while cooling the casting.

5 Claims, 4 Drawing Sheets

APPARATUS FOR HEAT TREATING CASTINGS CONTAINING CORES

BACKGROUND OF THE INVENTION

1. Field of the Invention

The present invention relates to a heat treatment apparatus that enables casting sand and core sand to be removed during heat treatment of castings.

2. Description of the Prior Art

To reduce the weight of castings, there is now a trend towards the use of cast aluminum instead of cast iron for automotive parts such as cylinder heads, and castings are becoming thinner and more complex in shape. FIG. 1(*a*) shows the steps used to make such a casting in a conventional arrangement. A core is used to obtain a cast of the part. After the casting process the casting thus obtained is cooled, subjected to cutting of the sprue gate, trimming and knocking-out, the core binder is then combusted in a sand furnace to recover the core sand and this is followed by heat treatment steps such as quenching, tempering and solution treatment. Since in this process the casting step is followed by a cooling step, the heat retained by the casting is wasted, in addition to which equipment and time are required for the cooling.

It has been proposed, in JP-B-61-50123, for example, to use as the core binder a resin having good heat collapse characteristics, and to recover the sand during the heat treatment by oxidizing or vaporizing the binder. In the case of the heat treatment process apparatus of JP-B-61-50123, the binder is oxidized by maintaining the casting in a furnace having a high oxygen concentration. However, when a core is located in castings that have a complex shape, the amount of oxygen and heat reaching the core is not enough to achieve full collapse of the core, resulting in incomplete removal and recovery of the core.

An object of this invention is to provide a heat treatment apparatus that can heat treat castings with high speed and economy.

A further object of this invention is to provide a heat treatment apparatus that readily enables the full removal of core sand even from castings having a complex shape.

SUMMARY OF THE INVENTION

To achieve the above object, the present invention provides an apparatus for heat treating castings, comprising a rack containing a casting that includes a core, a heating chamber that includes a vibration structure for vibrating the rack and in a lower portion thereof a first sand discharge structure for discharging sand falling from the casting, for removal of casting sand and core sand adhering to the casting while heat treating the casting, a cooling chamber that includes a water tank for immersion therein of the rack containing the casting, an elevator structure for lowering the rack into the water tank and lifting the rack out of the water tank, an oscillation structure for oscillating the rack when the rack is in the water tank, and a second sand discharge structure for discharging sand falling onto a bottom of the water tank, for washing off casting sand and core sand adhering to the casting ejected from the heating chamber while cooling the casting.

In the heat treatment apparatus of this invention thus configured, as in the conventional heat treatment apparatus solution treatment is carried out in the heating chamber. However, in the apparatus of this invention, by heating the casting to a prescribed temperature and vibrating the casting, the portion of the core binder adjacent to the surface of the casting that is oxidized can be removed. The casting sand that remains on the surface of the casting can also be removed by this vibration. Furthermore, when the casting has been heated for a prescribed time, bringing the whole core to a state where it readily collapses, the core sand can be removed by again applying vibration. The vibration can be effected by an impact structure or by any other structure able to produce the requisite vibration.

In the above heat treatment apparatus of this invention, as in the conventional heat treatment apparatus cooling is carried out in the cooling chamber. However, in the apparatus of this invention, by oscillating the casting immersed in the water tank, such as by oscillating the rack, for example, remaining core sand adhering to inside surfaces of the casting can be washed off. Casting sand still adhering to the surface of the casting can also be removed by this shaking. The oscillation can be effected by any structure able to produce the requisite shaking.

The heat treatment apparatus of this invention eliminates the need, in the case of the conventional arrangement shown in FIG. 1(*a*), to cool and knock out the casting before then reheating the casting for solution treatment. Instead, the casting can be subjected to solution treatment directly after removal from the casting machine or after cutting the sprue gate, as shown in FIGS. 1(*b*) and 1(*c*), thus reducing the number of process steps and the time required for the treatment.

Moreover, with the apparatus of this invention castings can be introduced into the heating chamber, directly or after removing the sprue gate, without first being cooled after being cast. Because the casting introduced into the heating chamber therefore still retains the heat imparted by the casting process, it takes less time to heat the casting to the prescribed temperature, thus reducing the time required for the heat treatment. The heat treatment apparatus of this invention is therefore particularly effective for continuous heat treatment of a plurality of castings, since it enables large numbers of castings to be heat treated in a short space of time. Taken together with the fact that it enables the number of process steps to be reduced, the present invention enables castings to be produced very economically.

Further features of the invention, its nature and various advantages will be more apparent from the accompanying drawings and following detailed description of the invention.

BRIEF DESCRIPTION OF THE DRAWINGS

FIG. 1(*b*) is a flow chart showing the steps of a casting process according to an embodiment of the present invention;

FIG. 1(*c*) is a flow chart showing the steps of a casting process according to another embodiment of the present invention;

FIG. 5(*b*) is a graph showing the relationship between solution treatment temperature and time, in the case of an embodiment of the present invention; and FIG. 5(*c*) is a graph showing the relationship between solution treatment temperature and time, in the case of another embodiment of the present invention.

DESCRIPTION OF THE PREFERRED EMBODIMENT

Figure 1A:
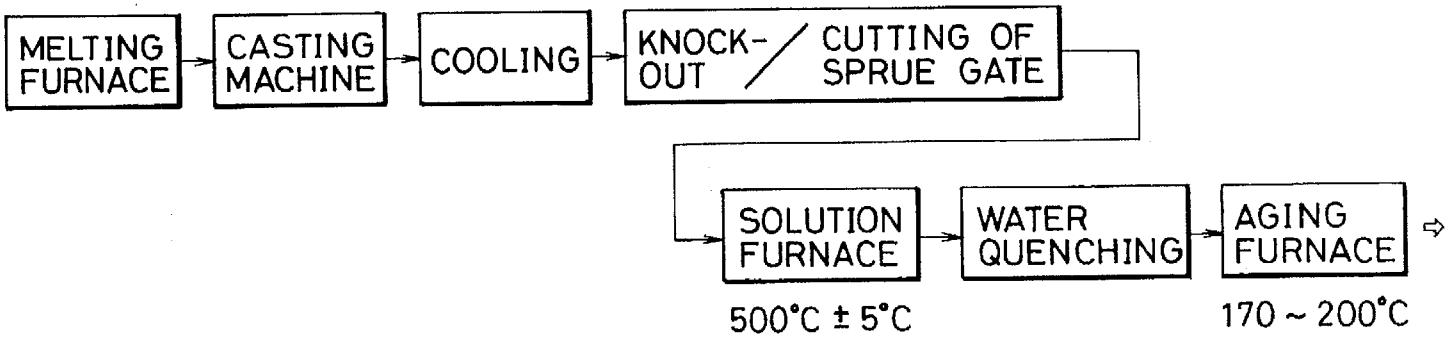
FIG.1(a) PRIOR ART
FIG. 1(*a*) is a flow chart showing the steps of a conventional casting process.
Figure 1B:
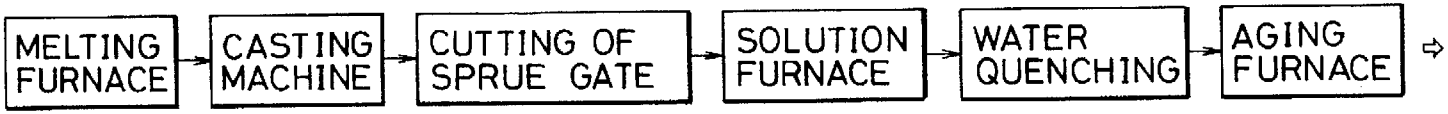
Figure 1C:
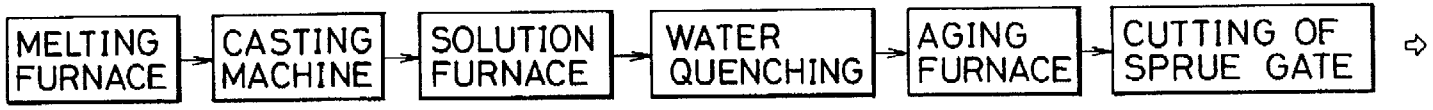
Figure 2:
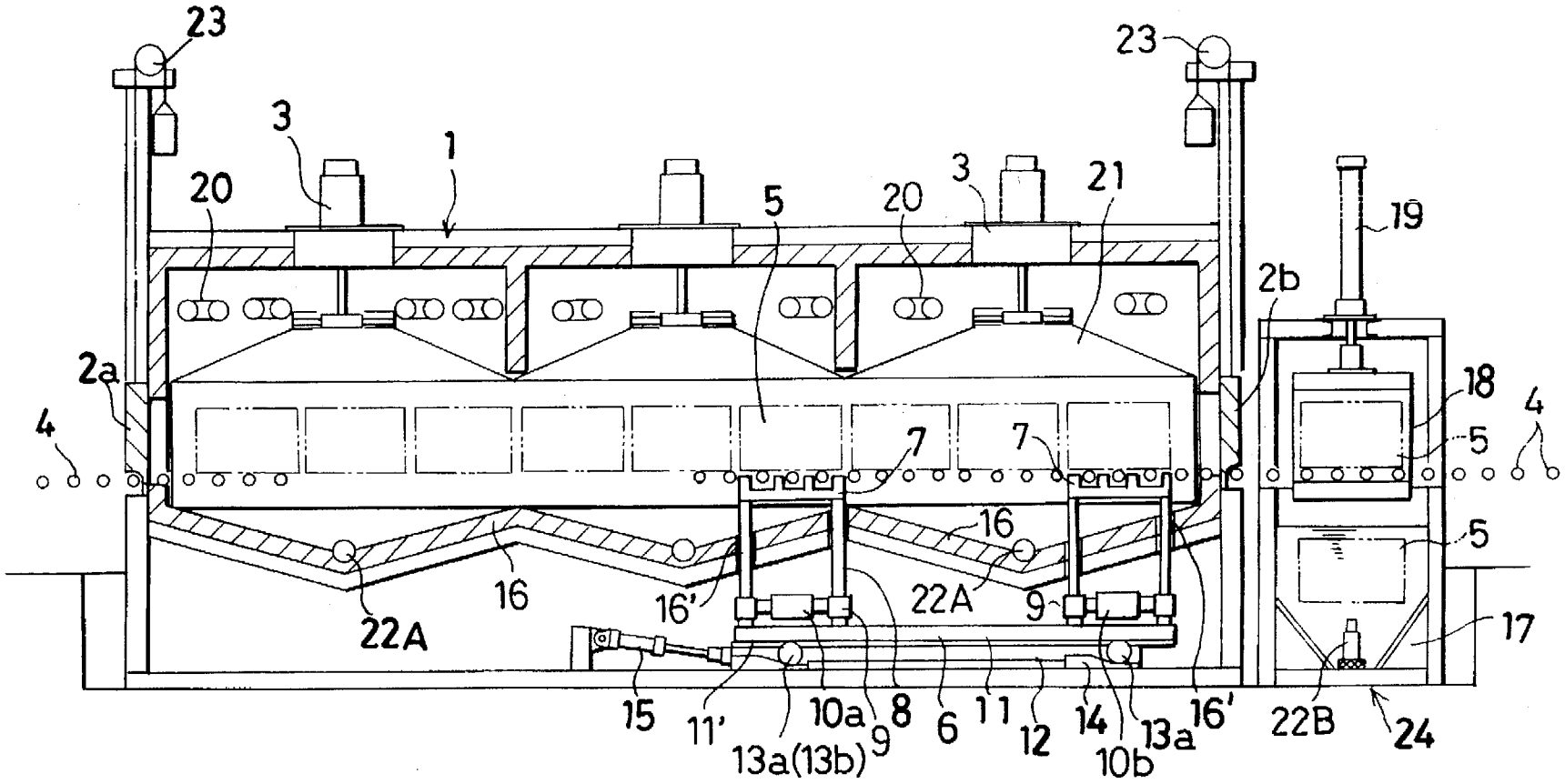
FIG. 2 is a sectional side view showing a continuous heat treatment apparatus according to an embodiment of this invention.

Details of the invention will now be described with reference to the heat treatment apparatus shown in the drawings. The continuous heat treatment apparatus, according to an embodiment of this invention, shown in FIG. 2 comprises a heating chamber (solution treatment furnace) 1, a vibration structure 6 provided inside the heating chamber 1, and a cooling chamber (water quenching chamber) 24.

The heat treatment apparatus of this invention is applied to castings having a complex shape that are cast using a core. After a casting has been cast using a casting machine (not shown), either after cutting the sprue gate or as-is, the casting is conveyed by hearth rolls 4 into the heating chamber 1 via an entrance 2*a* the door of which is opened by a winch 23. Inside the heating chamber 1 the casting, in a rack 5, is moved slowly and continuously forward through the heating chamber 1. During this movement the casting is subjected to heat treatment comprising fans 3 that blow air heated by radiant tubes 20 onto the rack 5.

Figure 4:
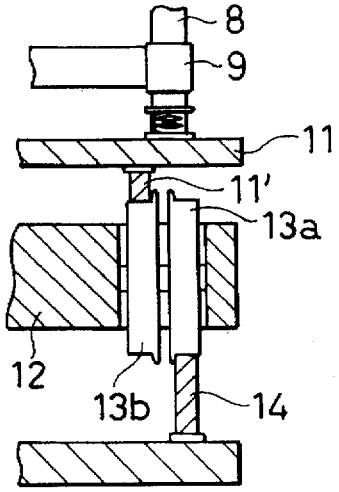
FIG. 4 is an enlarged view of the elevator structure in the apparatus of this invention.

After the elapse of a prescribed period of time, the rack 5 is positioned on a rack support 7 maintained above the vibration structure 6 by a plurality of supports 8. Each of the supports 8 is inserted in a through hole 16' in the hearth 16 and is attached at its lower end to an up-and-down frame 11. A vibrator 10*a* is attached between pairs supports 8 by springs 9. Below the up-and-down frame 11 is a tension frame 12 having a pair of wheels 13*a* and 13*b*, one at each end. As shown in FIG. 4, one of these wheels 13*b* engages with a rail 11' provided on the underside of the up-and-down frame 11, thereby supporting the up-and-down frame 11 while allowing the frame 11 to move longitudinally. The other wheel 13*a* engages with a rail 14 having a gradient, provided on the underside of the tension frame 12, thereby also supporting the frame 12 while allowing it to move longitudinally. One end of the tension frame 12 is connected to a cylinder 15. When the cylinder 15 is operated, the tension frame 12 is pulled, moving the wheel 13*a* up the gradient to the high part of the rail 14, which moves the tension frame 12 forwards and upwards. This movement of the tension frame 12 also causes the up-and-down frame 11 to try to move forward, but this movement is blocked by the supports 8 in the holes 16' of the hearth 16, so the up-and-down frame 11 is just elevated. As a result, the rack 5 on the hearth rolls 4 is raised by the rack support 7.

When the vibrator 10*a* is then operated, the vibration is communicated to the casting in the rack 5 by the springs 9, shaking free the core sand onto the hearth 16. After a prescribed period of time the vibrator 10*a* is stopped. The cylinder 15 is then reactivated to move the wheel 13*a* to the low part of the rail 14 and thereby bring the rack 5 back down onto the hearth rolls 4. When the rack 5 is back on the hearth rolls 4, the hearth rolls 4 are activated, whereby the rack 5 is slowly moved forward while being heated by air heated by the radiant tubes 20. When the rack 5 reaches the position of the next vibrator 10*b*, the hearth rolls 4 are stopped, and with the rack 5 positioned on the rack support 7, the rack 5 is vibrated by the vibrator 10*b* to remove casting sand and core sand. Sand falling onto the hearth 16 is discharged to the outside by a first sand discharger (screw conveyor) 22A.

With respect to an example in which the above heat treatment apparatus is used for solution treatment of a casting, the casting emerging from the casting machine is conveyed directly into a heating chamber heated to around 500° C., placed in a rack 5 and heat treated for about 150 minutes. Following this, the casting is subjected to three minutes of vibration by the vibrator 10*a*. The casting is then reheated as it is moved slowly forward, and after about 100 minutes it is again vibrated for three minutes, by the vibrator 10*b*, thereby removing core sand while proceeding with the solution treatment.

In this way, the casting is subjected to a prescribed period of heat treatment in the heating chamber 1, and at the same time is subjected to a multiplicity of vibration treatments at prescribed intervals, to remove casting sand and core sand. An exit 2*b* is then opened to allow the rack 5 to pass through the exit 2*b* and into an elevator frame 18 in the cooling chamber 24. When the elevator structure 19 is now activated, the rack 5 is lowered, immersing the casting in a water tank 17. When the elevator structure 19 is raised and lowered continuously, the rack 5 is oscillated by the water pressure thus produced. This oscillation makes it possible to wash off all core sand adhering to the inside surfaces of the casting. The sand thus washed off accumulates at the bottom of the water tank 17 and is discharged to the outside by a second sand discharge structure (sand pump) 22B. Thus, the elevator structure 19 not only immerses and raises the rack 5, but also imparts oscillations. After the core sand has been washed off by the action of the elevator structure 19, the rack 5 is lowered back onto the hearth rolls 4 and is thereby conveyed out of the apparatus for subsequent process steps.

Figure 3:
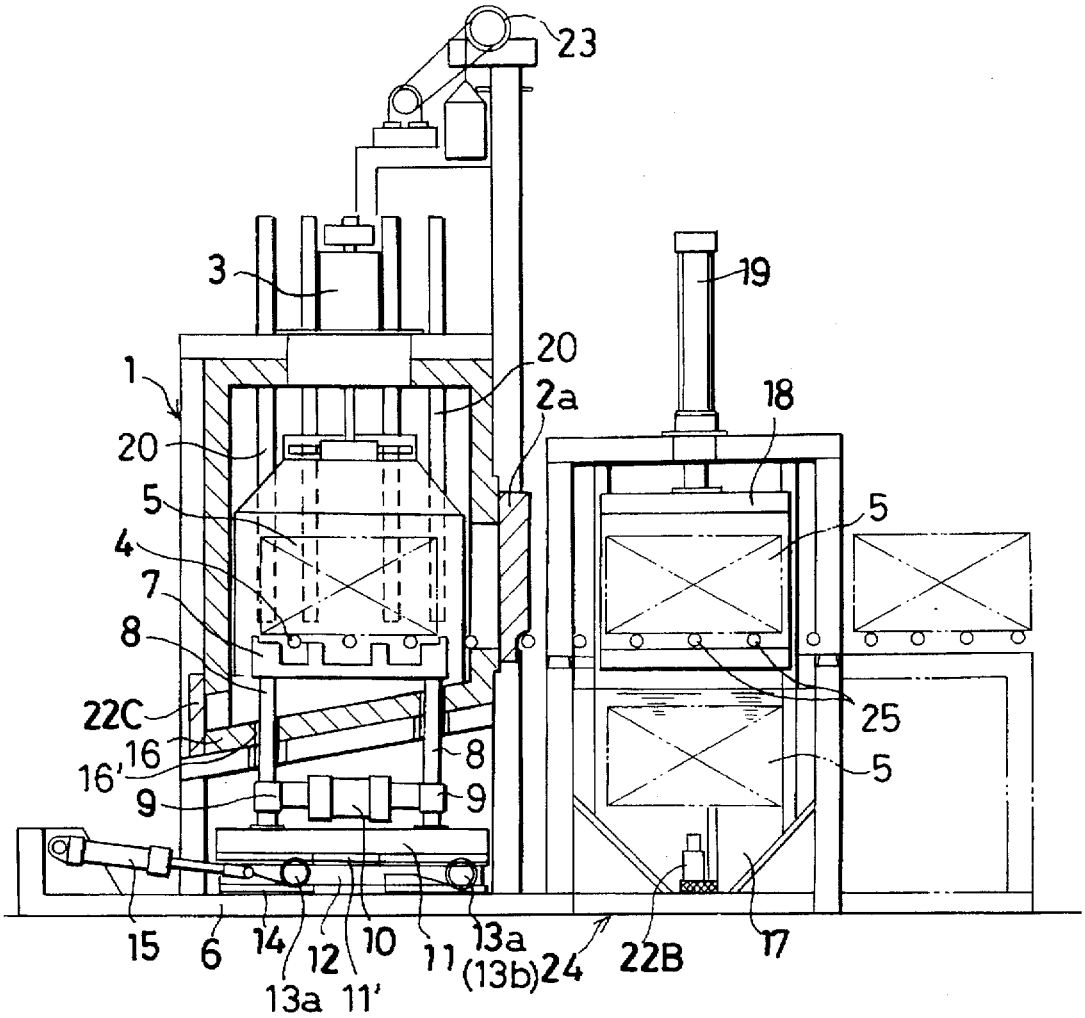
FIG. 3 is a sectional side view showing a batch-system heat treatment apparatus according to an embodiment of this invention.

FIG. 3 shows an embodiment of the heat treatment apparatus of the invention configured for batch type operation, comprising a heating chamber 1 that is used for both solution treatment and aging, a vibration structure 6 provided inside, and a cooling chamber (cooling apparatus) 24. The casting is placed in a rack 5 either as-is, or after cutting the sprue gate. The heating chamber 1 is heated to the solution treatment temperature, at which point entrance 2*a* is opened and hearth rolls 4 are operated to convey the rack 5 into the heating chamber 1 and position the rack 5 on the upper part of a rack support 7 arranged over a vibrator 10 of a vibration structure 6. The casting is then heated by radiant tube burners 20. Heated air is circulated in the heating chamber 1 by a fan 3.

The rack support 7 is supported on an up-and-down frame 11 by supports 8. The vibrator 10 is attached between two supports 8 by springs 9. As in the embodiment illustrated in FIG. 2, the up-and-down frame 11 is supported on a wheel 13*b* provided at one end of a tension frame 12 disposed beneath the up-and-down frame 11, and via the other wheel 13*a* the tension frame 12 is mounted on a rail 14 that has a gradient. Therefore, when the tension frame 12 is pulled by activating a cylinder 15 connected to one end of the tension frame 12, the wheel 13*a* is moved to the high part of the rail 14, whereby the up-and-down frame 11 rises and the rack 5 is raised by the rack support 7. When the vibrator 10 is then activated, the result is an intense vertical oscillation of the springs 9, which the rack support 7 communicates to the casting in the rack 5.

With respect to an example in which the above heat treatment apparatus is used for solution treatment of a casting, the casting is conveyed into the heating chamber heated to the required temperature for solution treatment (500° C.), where it is heat treated for about 150 minutes. This combusts the resin constituting the core binder, in the vicinity of the surface of the casting. Then vibrating the casting for three minutes causes core sand in the surface region of the casting to be shaken off onto the hearth 16. A further 100 minutes or so of heating allows the heat and oxidation to penetrate into the casting core and combust the core binder resin, bringing the core sand to a state in which it will readily collapse. Thus, nearly all of the core sand in the small recesses of the casting can be shaken free by again activating the vibrator 10 at this point. The falling sand accumulates on the inclined hearth 16, of the heating chamber 1, from where it can be ejected by opening a first sand discharge structure (door) 22C and manually raking it out, using a suitable implement (not shown).

Solution treatment is completed after the casting has been in the heating chamber 1 for 250 to 300 minutes. The cylinder 15 is then again activated, moving the wheel 13*a* of the tension frame 12 to the lower part of the rail 14 and lowering the rack support 7 together with the rack 5, to thereby bring the rack 5 back down onto the hearth rolls 4. The door of the entrance 2*a* is then opened and the hearth rolls 4 activated to convey the rack 5 from the heating chamber 1 and position it over the elevator structure 19 in the cooling chamber 24. The elevator structure 19 is operated to lower the rack 5 for immersion in the water tank 17, and following this immersion, the elevator 19 is used to repeatedly raise and lower the rack 5. This washes off sand remaining in the casting. The sand thus washed off accumulates at the bottom of the water tank 17 and is discharged to the outside by second sand discharge structure (sand pump) 22B. After completion of the washing process, the rack 5 is lowered back onto the hearth rolls 4 for conveyance on to subsequent process steps.

Figure 5A:
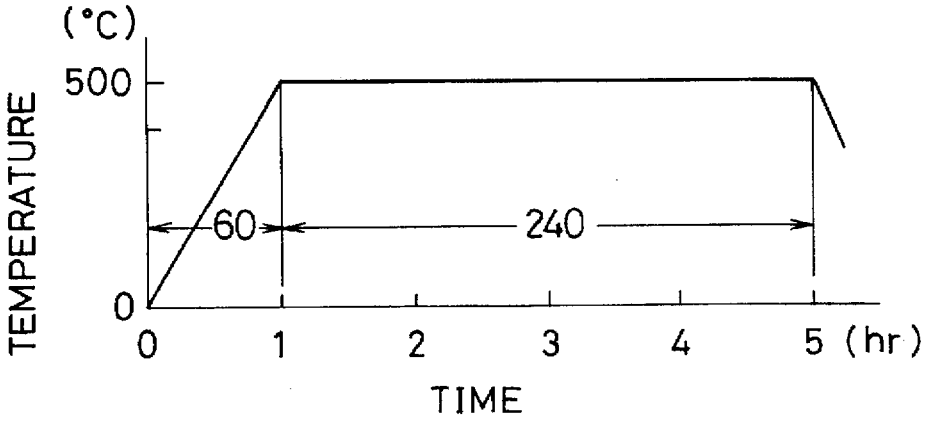
FIG.5(a) PRIOR ART
FIG. 5(*a*) is a graph showing the relationship between solution treatment temperature and time, in the case of a conventional arrangement.
Figure 5B:
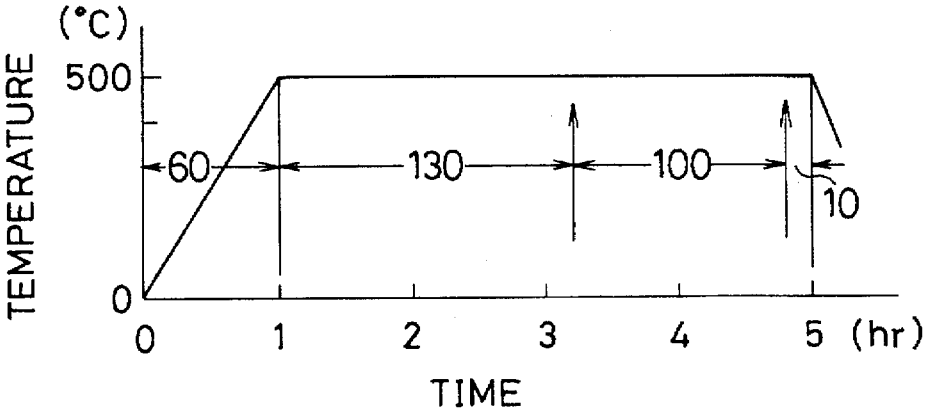
Figure 5C:
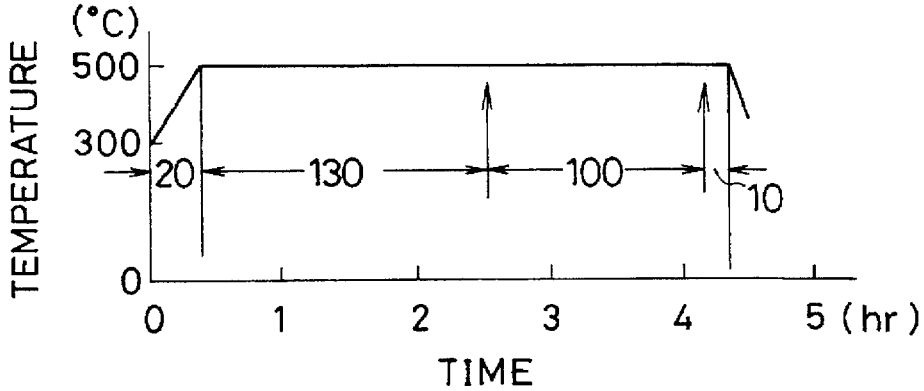

FIG. 5 shows graphs obtained relating to solution treatment of a cylinder head, using a conventional apparatus in the case of FIG. 5(*a*), and using the heat treatment apparatus of this invention in the case of FIGS. 5(*b*) and 5(*c*). In the case of FIG. 5(*a*) and FIG. 5(*b*) a room temperature cylinder head was subjected to some five hours of solution treatment in the heating chamber. However, in the case of FIG. 5(*b*) in which the inventive heat treatment apparatus was used, the cylinder head was twice subjected to 3 minutes' vibration, the first time 130 minutes and the second time 230 minutes, after being heated to 500° C. This vibration shook loose nearly all the core sand adhering to the interior surfaces of the cylinder head. However, in the case of the cylinder head of FIG. 5(*a*) that was only subjected to 240 minutes of heat treatment without being subjected to vibration, casting sand was removed from the outside surfaces of the cylinder head, but core sand on the inside could not be completely removed.

FIG. 5(*c*) relates to a cylinder head casting that was at a retained heat temperature of around 300° C. when placed in the heating chamber. As shown by FIG. 5(*c*), it took 20 minutes to heat the cylinder head to 500° C., meaning that it was possible to reduce the amount of power consumed by the apparatus and to reduce the time needed to accomplish the treatment.

In the foregoing the present invention has been described with reference to the above embodiments. It should be understood, however, that the apparatus according to these embodiments is not limited to the arrangements described and shown in the drawings but can also be constituted in various other configurations so long as these do not depart from the defined scope of the invention.

As described in the foregoing, with the heat treatment apparatus of this invention casting sand and core sand adhering to a casting can be removed while the casting is being heat treated in the heating chamber. As such, unlike in conventional configurations, there is no need to cool the casting immediately following the casting process for knocking-out. Thus, the apparatus of this invention reduces the number of process steps involved, and therefore also reduces the time it takes to produce castings.

Moreover, since with the apparatus of this invention castings can be continuously introduced into the heating chamber, directly or after cutting the sprue gate, without having to be cooled after being cast, the retained heat from the casting process can be effectively utilized to reduce the time it takes to heat the casting to the prescribed temperature in the heating chamber, thereby reducing the time required for the heat treatment. This ability to readily produce large numbers of castings in a short time makes this invention economical.

What is claimed is:

1. An apparatus for heat treating castings, comprising:

a rack containing a casting that includes a core;

a heating chamber that includes means for heating the rack, a vibration structure for vibrating the rack and in a lower portion thereof a first sand discharge structure for discharging sand falling from the casting, for removal of casting sand and core sand adhering to the casting while heat treating the casting; and a cooling chamber that includes a water tank for immersion therein of the rack containing the casting, an elevator structure for lowering the rack into the water tank and lifting the rack out of the water tank, an oscillation structure for oscillating the rack when the rack is in the water tank, and a second sand discharge structure for discharging sand falling onto a bottom of the water tank, for washing off casting sand and core sand adhering to the casting ejected from the heating chamber while cooling the casting.

2. A heat treatment apparatus according to claim 1, wherein the vibration structure includes a rack support, a plurality of supports holding the rack support, a vibrator provided between supports, and an elevator structure for raising and lowering the rack support.

3. A heat treatment apparatus according to claim 2, wherein the rack support elevator structure comprises an up-and-down frame that supports the plurality of supports, a tension frame disposed below the up-and-down frame having a pair of wheels at each end, one of each pair of wheels supporting the up-and-down frame thereon, an inclined rail on which the other of each pair of wheels is supported, and a cylinder associated with an end of the tension frame.

4. An apparatus for heat treating castings, comprising:

a rack containing a casting that includes a core; and a heating chamber that includes a vibration structure for vibrating the rack and in a lower portion thereof a sand discharge structure for discharging sand falling from the casting, whereby casting sand and core sand adhering to the casting are removed while the casting is heat treated.

5. An apparatus for heat treating castings, comprising:

a rack containing a casting that includes a core;

a heating chamber for heat treating the rack therein; and a cooling chamber disposed adjacent to the heating chamber and including a water tank for immersion therein of the rack conveyed from the heating chamber, an elevator structure for lowering the rack into the water tank and lifting the rack out of the water tank, an oscillation structure for oscillating the rack when the rack is in the water tank, and a sand discharge structure for discharging sand falling onto a bottom of the water tank;

whereby casting sand and core sand adhering to the casting are removed while the heat treated rack is cooled.

* * * * *